US010526155B2

(12) United States Patent
Paanasalo et al.

(10) Patent No.: US 10,526,155 B2
(45) Date of Patent: Jan. 7, 2020

(54) METHOD OF CONTROLLING OPERATION OF A WINDER FOR A FIBER WEB

(71) Applicant: Valmet Technologies Oy, Espoo (FI)

(72) Inventors: Jari Paanasalo, Järvenpää (FI); Kenneth Åkerlund, Helsinki (FI); Mikko Veijalainen, Jokela (FI)

(73) Assignee: VALMET TECHNOLOGIES OY, Espoo (FI)

( * ) Notice: Subject to any disclaimer, the term of this patent is extended or adjusted under 35 U.S.C. 154(b) by 89 days.

(21) Appl. No.: 15/933,164

(22) Filed: Mar. 22, 2018

(65) Prior Publication Data

US 2018/0273328 A1 Sep. 27, 2018

(30) Foreign Application Priority Data

Mar. 23, 2017 (FI) ..... 20175275

(51) Int. Cl.

| | |
|---|---|
| ***B65H 18/26*** | (2006.01) |
| ***B65H 23/198*** | (2006.01) |
| ***B65H 18/20*** | (2006.01) |
| ***B65H 18/10*** | (2006.01) |
| ***B65H 20/02*** | (2006.01) |

(52) U.S. Cl.

CPC ..... *B65H 18/26* (2013.01); *B65H 18/10* (2013.01); *B65H 18/20* (2013.01); *B65H 20/02* (2013.01); *B65H 23/198* (2013.01); *B65H 2513/106* (2013.01); *B65H 2515/31* (2013.01); *B65H 2553/22* (2013.01)

(58) Field of Classification Search

CPC ..... B65H 18/10; B65H 18/20; B65H 18/26; B65H 20/02; B65H 23/198

See application file for complete search history.

(56) References Cited

U.S. PATENT DOCUMENTS

| | | | | |
|---|---|---|---|---|
| 3,910,521 A | | 10/1975 | O'Callaghan et al. | |
| 4,128,213 A | * | 12/1978 | Komulainen | B65H 18/20 242/541.5 |
| 4,811,915 A | * | 3/1989 | Smith | B65H 18/20 242/534.2 |
| 5,150,850 A | * | 9/1992 | Adams | B65H 18/20 242/541.3 |
| 5,553,806 A | * | 9/1996 | Lucas | B65H 18/16 242/542.4 |
| 6,089,496 A | | 7/2000 | Dorfel | |

(Continued)

FOREIGN PATENT DOCUMENTS

| | | |
|---|---|---|
| EP | 2133298 A2 | 12/2009 |
| GB | 2117935 A | 10/1983 |

*Primary Examiner* — Sang K Kim

(74) *Attorney, Agent, or Firm* — Stiennon & Stiennon

(57) ABSTRACT

This invention relates to a method of controlling the operation of a winder in which method while forming at least one fiber web roll the fiber web is brought on the web roll via a nip formed by a first support drum and the web roll, which first support drum is driven by a first drive assembly (20) applying controllable torque to the drum and the winding force is applied to the web roll by a second drive assembly (22). In the method the second drive assembly (22) is controlled based on the indicative speed difference of the second drive assembly (22) and setting a friction coefficient for determination of maximum winding force.

10 Claims, 2 Drawing Sheets

(56) References Cited

U.S. PATENT DOCUMENTS

| | | | | |
|---|---|---|---|---|
| 6,170,777 | B1 * | 1/2001 | Dorfel | B65H 18/20 242/541.5 |
| 6,209,817 | B1 * | 4/2001 | Conrad | B65H 18/26 242/413 |
| 6,260,789 | B1 * | 7/2001 | Cramer | B65H 18/20 242/530.3 |
| 2008/0197228 | A1 | 8/2008 | Mueller et al. | |
| 2012/0126049 | A1 * | 5/2012 | Gruzdaitis | B65H 23/185 242/412 |

* cited by examiner

METHOD OF CONTROLLING OPERATION OF A WINDER FOR A FIBER WEB

CROSS REFERENCES TO RELATED APPLICATIONS

This application claims priority on Finish application FI 20175275 Filed Mar. 23, 2017 which is incorporated herein by reference.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method of controlling operation of a winder for a fiber web.

On a slitter-winder of a fibrous web, such as paper or board, a full-width web is unwound from a so-called machine reel and the web is slit into several partial webs and the partial webs are wound into so-called customer rolls.

The operating process of the slitter-winder mainly comprises a so-called set change and a slitting process as successive steps. The slitting process may be considered including an acceleration step after the set change, a normal slitting step and a deceleration step preceding the set change. Of these, the normal state slitting step takes the most time by far. The web speed of the slitter-winder can typically be even 50 m/s. The roll formation in a winder is controlled by effecting on various variables depending on e.g. a type of a winder.

As an example, a commonly used type of a winder is a so called carrier roll winder, in which the set of rolls is supported by two carrier elements, such as two king rolls or a drum and a belt assembly. In such a winder the roll formation is mainly effected by the used winding forces between the roll and the support drums, web properties, as well as the nip load.

The partial webs are brought to the winder via a drum, which in a carrier drum winder is the rear drum and in a center wind winder the center drum. In a carrier drum winder there is a front drum (or a support belt assembly) provided, which together with the rear drum forms the winding cradle on which the set of wound rolls are being wound. Additionally, the partial web rolls are supported by a press device, typically a press roll, generally above the set of rolls. In the carrier drum winder both the front and the rear drums are driven, typically by a dedicated motor. In a centerwind winder the center drum is driven, but also the web roll itself is driven at its winding core or a shaft.

Recently, the efficiency of the slitter-winder has been improved considerably by increasing running speeds, among others. The total efficiency is naturally affected by efficiency in all above steps, and therefore used speeds and accelerations are typically intended to be maximized. Therefore, it is evident that reeling forces are also maximized, but within the limits of properties of the winder and the web.

It is common practice in connection within a field of control of electric motor drives with frequency converter to apply torque control. A set torque reference range is followed by the drive. If the range is for any reason exceeded the speed controller activates and takes over the control. It has been discovered that this kind of procedure does not provide a solution fast enough for adequately preventing loss of traction in an application of the web winder.

U.S. Pat. No. 6,089,496 A discloses a method of controlling operation of a winder for a fiber web in which method fiber web is brought on the web roll via a nip formed by a first support drum and the web roll which first support drum is driven by a first drive assembly applying controllable torque to the drum, and applying winding force to the web roll by a second drive assembly. According to the document the torque and nip loads for changing the tension remaining in the wound web roll operate such that the tension of the web first decreases at increasing web roll diameter of said at least one web roll during an initial winding phase, then stays approximately at the same level and, after winding further, decreases further at increasing wound web roll diameter during a final winding phase.

GB 2117935 A discloses a method of controlling the internal tension of a web roll, e.g. a paper web roll, during winding of the roll in a winder having two individually driven supporting rollers, the rotational speeds of the supporting rollers or their drive members are measured and the speed signals are fed to control means to maintain a desired speed difference therebetween.

EP 2133298 A2 discloses a method of optimizing the operation of a device to roll up a sheet of material in a winder. The winder comprises carrier rolls the drives of which are individually controlled such that the first support roller is speed controlled and the second support roller is torque controlled.

The existence of friction in various moving and rotating parts of a winder is known as such, an example of which is referred to US 2008197228 A1, which discloses a method for friction compensation in a winding machine, with which a material is wound onto a winding drum, and the winding drum is driven by a winding drive which is triggered by a control/regulating device, and in the control/regulating device a driving torque of the winding drive is specified, and in a friction compensation unit, as an input-side process parameter, a winding speed of the winding drum is taken into account, in which to compensate for the frictional torque, at least one additional process parameter is taken into account.

U.S. Pat. No. 3,910,521A discloses a winder control for programming the torque to be applied by a winder to effect winding of material into a roll wherein the tension applied to the material to be wound is dependent upon the instantaneous radius of the roll of wound material, the winder includes first sensing means for sensing the angular velocity of the roll of material and producing a signal indicative thereof, second sensing means for sensing the linear velocity of the material to be wound, and producing a signal indicative thereof, and divider means for generating a signal indicative of the instantaneous radius of the roll of wound material. The radius signal is directed to means for multiplying the instantaneous radius signal by a factor indicative of the desired tension to be applied to the material when the roll of material has a predetermined radius. This establishes a torque signal indicative of the torque the winder must apply to the roll of material to obtain the predetermined tension in the material to be wound at the instantaneous radius calculated by the divider means.

Even if the torque would be effectively controlled, when maximising the productivity of the winder, it is evident that the winding forces transmitted by the drives over the nips have a tendency to be at the limits of capability of the nip of transferring the force without hampering the quality of the web or without slipping of the counter surfaces in the nip.

The capability of a nip to transfer force is mainly dependent on nip force and a friction coefficient in the nip.

An object of the invention is to provide a method of controlling the operation of a winder in which the performance is considerably improved compared to the prior art solutions.

SUMMARY OF THE INVENTION

According to an embodiment of the invention in the method of controlling operation of a winder for a fiber web in which method while forming at least one fiber web roll:

the fiber web is brought on the web roll via a nip formed by a first support drum and the web roll, which first support drum is driven by a first drive assembly applying controllable torque to the drum;

the winding force is applied to the web roll by a second drive assembly;

the winding force is controlled by executing at least the following steps:

(a) an initial value for an indicative coefficient ($F_s$) is set;

(b) a set value for the winding force is determined using a function $$F_s=f(\mu_n,N)$$

where:

$F_s$=set value for winding force [N/m], $F_s$=the indicative coefficient,

N=nip force [N/m] at a nip over which the winding force is transmitted, (c) at least the second drive assembly is controlled by using the set value for the winding force;

(d) an indicative speed of the first drive assembly and/or the first support drum is determined using a first predetermined time interval, and an indicative speed of the second drive assembly is determined using a second predetermined interval;

(e) the indicative speed of the second drive assembly is compared with the indicative speed of the first drive assembly, and (f) in case the difference between the indicative speed of the second drive assembly and the indicative speed of the first drive assembly is greater than a predetermined set difference, the indicative coefficient value is corrected; and (g) the steps (b) to (f) are repeated.

By means of the invention it is possible to control, or limit, the winding force in which case also the applied torque is changed accordingly. The use of the indicative coefficient in the controls enhances the traction control by making it possible to react faster to loss of traction and to react at considerably small speed differences. In practical circumstances the invention makes is possible to prevent the loss of control and not only limit the speed difference of the first and the second support drum.

According to an embodiment of the invention the indicative speed of the first drive assembly and/or the first support drum is a surface speed of the first drum, and an indicative speed of the second drive assembly is the surface speed accomplished by the second drive assembly to the web roll.

According to an embodiment of the invention the indicative speed of the first drive assembly and/or the first support drum is determined using a first predetermined time interval, and an indicative speed of the second drive assembly is determined using a second predetermined interval.

According to an embodiment of the invention the step (f) comprises a further control rule according to which, in case the difference between the indicative speed of the second drive assembly and the indicative speed of the first drive assembly is smaller than a predetermined set difference, the indicative coefficient value is increased.

According to an embodiment of the invention the step (f) comprises a further control rule according to which, in case the difference between the indicative speed of the second drive assembly and the indicative speed of the first drive assembly is greater than a predetermined set difference, the indicative coefficient value is decreased.

According to an embodiment of the invention the web roll is supported by at least one additional drum support member, such as a drum or a belt assembly, and which additional drum support member is driven by the second drive assembly applying controllable torque to the additional drum support member.

According to an embodiment of the invention in the step (c) the second drive assembly is controlled by using the set value for the winding force, such that a maximum torque which the second drive assembly applies to the drum support member is calculated from the set value for the winding force.

According to an embodiment of the invention the indicative coefficient is a function of at least one of the following variables: the indicative speed of the first drive assembly, the indicative speed of the second drive assembly, a thickness of a separate surface layer of a drum, a thickness of a belt in a belt assembly and a nip force.

According to an embodiment of the invention the indicative coefficient value is updated or corrected based on a detected change of at least one of the following: the indicative speed of the first drive assembly, the indicative speed of the second drive assembly, a thickness of a separate surface layer of a drum, a thickness of a belt in a belt assembly and a nip force.

According to an embodiment of the invention the set value for the winding force is calculated using the function $F_s=F_s \cdot N$, where $F_s$=set value for winding force [N/m], $F_s$=the indicative coefficient and N=nip force [N/m] at a nip over which the winding force is transmitted.

According to an embodiment of the invention the step (c) the second drive assembly is controlled by using the set value for the winding force, such that a maximum torque which the second drive assembly applies to the web roll is calculated from the set value for the winding force.

According to an embodiment of the invention during the method the speed of the winder is accelerated or decelerated while practicing the method.

This provides a method for controlling an operation of a fiber web winder where the performance is considerably improved.

In this context, since the fiber web is brought on the web roll via a nip formed by a first support drum and the web roll, in practical circumstances the first support drum cannot lose its grip or traction to the web roll. During the winding the web speed is maintained by controlling the first drive assembly. Therefore, the surface speed of the first support drum is equal to the surface speed of the web roll. Thus, the indicative speed of the first drive assembly also represents the surface speed of the web roll. Therefore, if so desired the indicative speed of the first drive assembly and/or the first support drum can be determined by means of determining the rotational speed and current diameter of the web roll, as an alternative solution.

By means of the invention the speed difference can be controlled to be very small. Also, by means of the invention it is possible to react very quickly to changes in the speed difference. Therefore, by means of the invention, a loss of traction can be practically avoided.

Also, executing the invention does not result in practically any disturbance on the running speed or web tension.

A corresponding problem may also be solved in a continuously operating reel-up in a fiber web machine, such as a paper, board or pulp drying machine.

For clarity reasons, in this connection the web roll is referred to by the word "roll" and a word "drum" is used for parts of the winder.

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated. The novel features which are considered as characteristic of the invention are set forth in particular in the appended claims.

BRIEF DESCRIPTION OF THE DRAWINGS

In the following, the invention will be described with reference to the accompanying exemplary, schematic drawings, in which.

DESCRIPTION OF THE PREFERRED EMBODIMENTS

Figure 1:
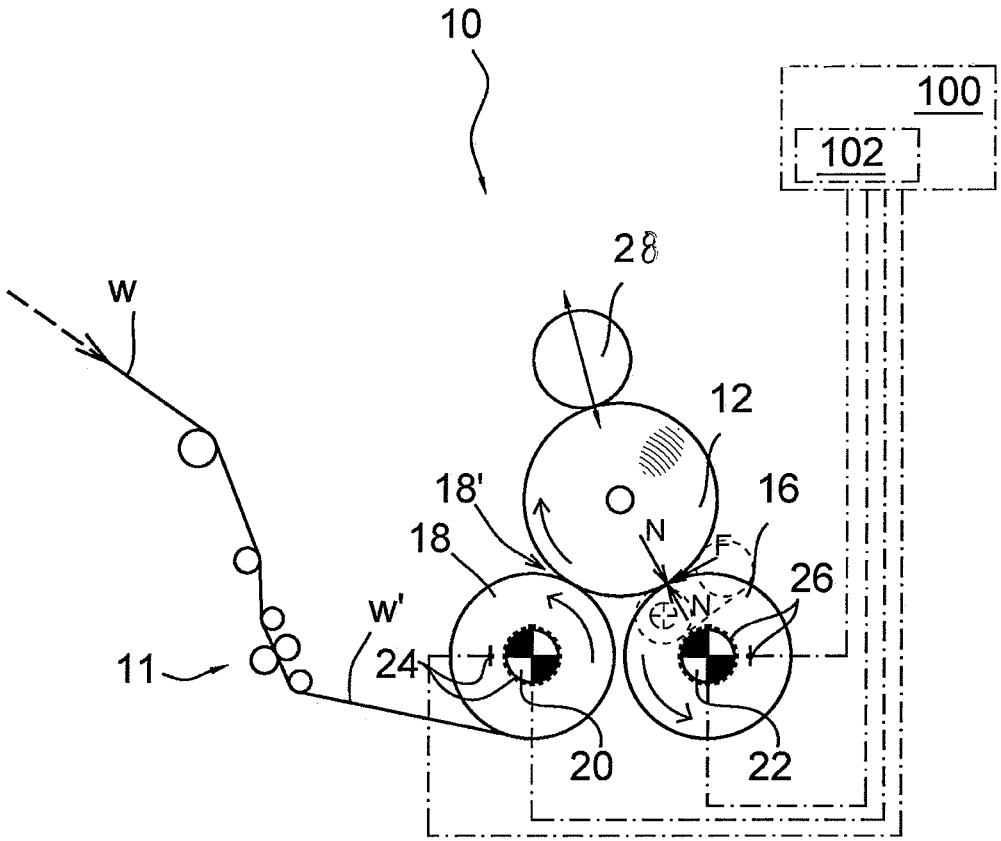
FIG. 1 illustrates a winding section according to an embodiment of the invention.

FIG. 1 depicts schematically a winding section in a slitter winder for a fiber web. The figure shows a so called two drum winder 10, where parallel web rolls 12 to be wound from partial webs w' are formed in support of a front drum 16 and a rear drum 18, as well as by a press roll 28. In the winding section there is a slitting section 11 to which a full width web w is guided and in which the web w is slit into at least two partial webs w' while the web is running under control of a number of guide rolls. The parallel partial webs w' are guided to the rear drum 18 and are brought on the set of rolls 12 via a nip 18' formed between the rear drum 18 and the set of web rolls 12. Both the rear drum 18 and the front drum 16 are provided with a dedicated drive 20, 22 in order to controllably rotate the drums. Here the drive alone or a combination of the drum and its drive are called a drive assembly. The winding section 10 is provided with a control computer 100 which is arranged to control the operation of the drives, such as electric motors 20, 22. Under normal conditions the control of the motors is based on torque control whereas the rotational speed of the motors is maintained as close as possible to a set value by controlling the torque applied by the motor.

Each one of the drums 18, 16 is provided with a speed sensing device 24, 26, which comprises suitable sensors. The speed sensor is used to determine the speed, acceleration or deceleration of the drum. As an example, such sensors may use a magnet and a Hall-effect sensor, or a toothed wheel in connection with the drum and an electromagnetic coil to generate a signal. The signal is made available to the controller computer 100 for use in controlling the operation of the winder section 10.

When the winder is running the rear drum 18 is operated such that the speed of the web w is controlled by the rear drum 18 and the tension of the web is controlled by an unwinder (not shown) from which the web w is fed to the winder section 10. The front drum 16 is configured to provide torque to web rolls 12, which torque is controlled based on special rules which are configured to the computer controller 100. By means of the torque applied by the front drum 16 it is possible to have an effect on the formation and quality of the web rolls 12.

In the FIG. 1 there is shown an embodiment of the invention where the front drum 16 has been replaced by a belt assembly which supports the rolls 12 over a wider area. The belt assembly, which is depicted by a dashed line here, is provided with guide rolls and is driven by a motor. Therefore the invention is similarly applicable to such a winder also. The belt assembly may also be referred to as a drive assembly. When a speed is discussed in this context it means the web speed or a surface speed of a drum or a belt unless otherwise specifically mentioned.

Now, the traction control unit 102 for the front drum 16 is provided or configured into the control computer 100. The traction control unit 102 comprises instructions to control the drive 22 of the front drum 16 in order to prevent loss of traction of the driven front drum 16 against the web roll 12. The traction control unit 102 controls the torque i.e. winding force applied by the front drum 16 to the web roll 12 by means of specific executable instructions. This way, depending for example on the properties of the web and surface speed of the drum 16, a maximum torque set value is determined such that loss to traction can be practically avoided. The winding force applied to the web roll is proportional to the torque applied to the front roll 16 and therefore, the other one can be determined if the other one is known, since the radius of the front drum 16 is also known.

The controller computer, and specifically the traction control unit 102 thereof according to an embodiment of the invention comprises instructions to (a) setting an initial value for an indicative coefficient ($F_s$), (b) setting the winding force using a function $$F_s = f(\mu_n, N)$$

where:

$F_s$=set value for winding force [N/m], $\mu_n$=the indicative coefficient,

N=nip force [N/m] at a nip over which the winding force is transmitted, stored in the controller computer, (c) controlling at least the second drive 22 assembly by using the set value for the winding force, (d) determining an indicative speed of the first drive assembly 20 and/or the first support drum using a first predetermined time interval, and determining an indicative speed of the second drive assembly 22 using a second predetermined interval, (f) comparing the indicative speed of the second drive assembly 22 with the indicative speed of the first drive assembly 20, and (g) in case the difference between the indicative speed of the second drive assembly and the indicative speed of the first drive assembly is greater than a predetermined set difference, correcting the indicative coefficient value, (h) repeating steps (b) to (g).

The method is executed by practicing at least the following steps. The method can be realized by operating the controllable computer 100 by executing the instructions stored in the control computer 100.

Firstly an initial value is set for an indicative coefficient (step a). The indicative coefficient represents a friction coefficient between the front drum 16 and the web roll 12 (or between the belt assembly and the web roll, if that is the case). The indicative coefficient is at its simplest form a friction coefficient, which may in some practical application provide adequate operation. The initial value is set based on empirical data relating to the practical parameters of the case, like surface properties of the fiber web. It is set substantially close to a best estimate of the correct value and during the execution of the method the value is corrected on-line based on the detected traction performance. The indicative coefficient may include correction factors which take into account, for example, the speed of the web which effects on tendency of the air entering between the web layers.

The next phase (step b) comprises determination of a set value for the winding force. The winding force is determined as a function which is using as its variables at least the indicative coefficient $\mu_n$, and nip force N at a nip over which the winding force is transmitted. As its simplest form the set value for the winding force is determined as $F=\mu_n \cdot N$. To be more specific, in case of the winder is a carrier drum winder, the winding force refers to the front drum (or a belt assembly). In case of a centerwind winder the winding force refers to the torque applied to the winding shaft of the web roll. The set value is utilized in the control method as a maximum value for the winding force.

In the next step (step c) at least the second drive assembly 22 is controlled by using the set value for the winding force. In practice the winding force represents the torque set value assigned to a drive controller such as a frequency converter.

In the following step (step d), an indicative speed of the first drive assembly 20 and/or the first support drum is determined using a first predetermined time interval, and an indicative speed of the second drive assembly 22 is determined using a second predetermined interval. Advantageously the first predetermined interval is equal to the second predetermined interval, such that a pair of indicative speeds is determined substantially simultaneously.

Next (step e) the indicative speed of the second drive assembly 22 is compared with the indicative speed of the first drive assembly 20. In this step a possible loss of traction is revealed by any difference between the indicative speeds. Advantageously the actual difference between the indicative speed of the second drive assembly and the indicative speed of the first drive assembly is compared with a predetermined set difference value. The set difference may differ based on the case. The factors which effect the allowable difference in the indicative speeds comprises at least one of the following: fiber web grade, surface properties of the fiber web, resilient drum cover properties, nip loading and roll diameter.

The indicative speed of the second drive assembly 22 and the indicative speed of the first drive assembly 20 may be the actual surface speed of the drums (or belt assembly). However, advantageously the indicative speed is based on the actual speed value which is corrected by certain factors.

Such factors may be for example related to the surface of the drums, and particular to the surface of the belt assembly. When there is a resilient layer involved in the nip the control will be more accurate when for example the compression of such resilient layer is taken into account. This is because the compression effects the effective radius of the torque applied.

In connection with an embodiment where the belt assembly is used as the front drum, the resilient belt brings more challenge to the application of the method. The belt wears out during use and it is compressed during the winding sequence when it supports the web rolls. These phenomena are taken into account when determining the indicative speed. Thus, the indicative speed follows a calibration curve which takes into account the characteristics of the belt and the change of thickness of the belt.

Next, in case the actual difference between the indicative speed of the second drive assembly and the indicative speed of the first drive assembly deviates from the predetermined set difference value, i.e., the difference between the indicative speed of the second drive assembly and the indicative speed of the first drive assembly is greater than a predetermined set difference, the indicative coefficient value is corrected, (step f). Now, depending on if the difference between the indicative speed of the second drive assembly and the indicative speed of the first drive assembly is positive or negative, the indicative coefficient value is decreased or increased.

More precisely, if the indicative speed of the first drive assembly is greater than the indicative speed of the second drive assembly the indicative coefficient value is decreased. This leads to a situation where also the set value for the maximum winding force is decreased. Based on this, also the drive controller decreases the torque set value.

Figure 2:
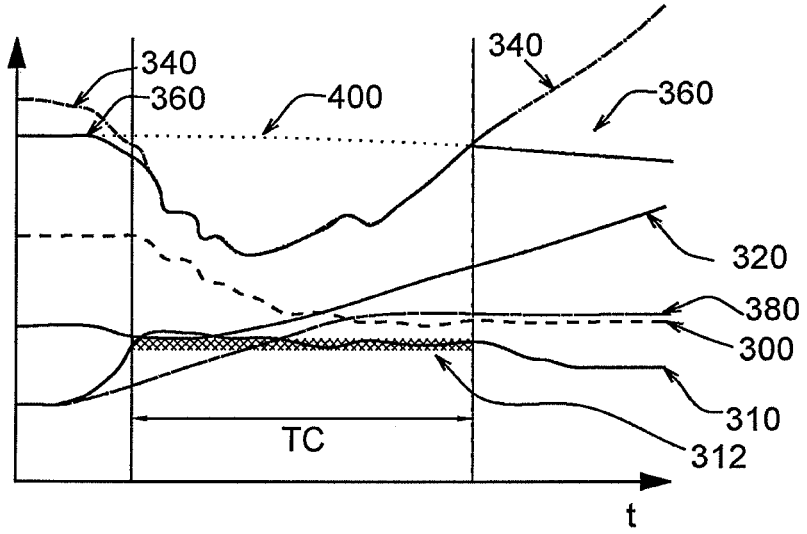
FIG. 2 illustrates a chart of an operation of an exemplary embodiment according to an embodiment of the invention.

In the FIG. 2 there is shown an exemplary chart where the operation of the invention can be seen during an increase of speed. The horizontal axis represents time and the vertical axis represents magnitude of each variables in the chart, which variables are shown as lines with different patterns. The variables shown are: a speed difference 310 between the front drum 16 and the rear drum 18. The speed of the rear drum 18 can be considered to be substantially equal to the surface speed of web rolls 12; a nip force 320 at the nip over which the winding force is transmitted, i.e., between the front drum 16 and the web roll 12; a set value for the winding force 340 used in the traction control of the rear drum and in the traction control unit 102; actual winding force 360; speed of the web 380; and indicative coefficient 300 used in the traction control and the traction control unit 102. There is also shown a general reference value 400 for the winding force.

The chart shows an exemplary situation where the set of rolls 12 are accelerated from standstill to a desired running speed which can be seen from the curve 380. The figure relates particularly to an effect of the air to the winding while the speed increases. At the beginning of the acceleration, the indicative coefficient 300 has a considerably high value. The initial value for the indicative coefficient can be set considerably close to the correct value and executing the method set the value substantially quickly to the appropriate level due to its on-line adjustment. The curve 310 shows that shortly after starting the acceleration, the speed difference between the front and the rear support drum increases steeply. When the speed difference increases above a predetermined set difference value, or a range 312, the value of the indicative coefficient 300 is decreased accordingly. This is clearly shown in the curve 300. This results in maintaining the speed difference between the front and the rear support drums at an acceptable or desired level. The actual acceptable speed difference is set suitably to assure that the fiber web roll quality does not suffer but still the acceleration stage is as short as possible.

In the FIG. 2 there is shown a time period TC during which the method i.e. the traction control is active. During the time the traction control is active the actual winding force 360 is lower than the general reference value 400 indicating the effect of the invention. The value of the indicative coefficient 300 is decreased until the speed difference 310 is within the range 312 and the set value for the winding force 340 overrules the general reference value 400. After the traction control is deactivated the indicative coefficient is substantially constant. Since the indicative coefficient is corrected substantially continuously it is possible to use maximum winding forces without the risk of loss of traction and without the risk of unduly slowing down the speed.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such combination is technically feasible.

We claim:

1. A method of controlling operation of a winder for a fiber web while forming at least one fiber web roll, comprising the steps of:

guiding the fiber web onto the web roll via a nip formed between a first support drum and the web roll;

applying a controllable torque to the first support drum with a first drive assembly;

applying a winding force to the web roll by a second drive assembly;

wherein the winding force is controlled by executing at least the following steps:

(a) setting an initial value for an indicative coefficient ($\mu_n$);

(b) determining a set value for the winding force using a function $F_s=f(\mu_n, N)$ wherein:

$F_s$=set value for winding force [N/m], $\mu_n$=the indicative coefficient,

N=nip force [N/m] at a nip over which the winding force is transmitted, (c) at least the second drive assembly is controlled by using the set value for the winding force;

(d) determining a first indicative speed of at least one of the first drive assembly and the first support drum, and determining a second indicative speed of the second drive assembly;

(e) comparing the second indicative speed with the first indicative speed, and determining a difference value;

(f) when the difference value, is different than a predetermined set difference, the indicative coefficient value is corrected; and (g) the steps (b) to (f) are repeated so long as the winder is in operation.

2. The method of claim 1 wherein the first indicative speed is measured using a first predetermined time interval, and the second indicative speed is measured using a second predetermined interval.

3. The method of claim 1 wherein step (f) comprises a further control rule according to which, in case the difference value is smaller than the predetermined set difference, the indicative coefficient value is increased.

4. The method of claim 1 wherein step (f) comprises a further control rule according to which, in case the difference value is greater than the predetermined set difference, the indicative coefficient value is decreased.

5. The method of claim 1 wherein the web roll is supported by a second drum support member, comprising a drum or a belt assembly, and the drum support member is driven by the second drive assembly applying a controllable torque to the drum support member.

6. The method of claim 1 wherein step (c) the second drive assembly is controlled by using the set value for the winding force, such that a maximum torque which the second drive assembly applies to the drum support member is calculated from the set value for the winding force.

7. The method of claim 1 wherein the indicative coefficient is a function of at least one of the following variables: the indicative speed of the first drive assembly, the indicative speed of the second drive assembly (22), a thickness of a separate surface layer of a drum, a thickness of a belt in a belt assembly, nip force and roll diameter.

8. The method of claim 7 wherein the value of $\mu_n$ is updated based on detected change of at least one of the following: the indicative speed of the first drive assembly, the indicative speed of the second drive assembly, a thickness of a separate surface layer of a drum, a thickness of a belt in a belt assembly and a nip force.

9. The method of claim 1 wherein the set value for the winding force is calculated using the function $F_s=\mu_n \cdot N$.

10. The method of claim 1 wherein during winder operation the speed of the winder is accelerated or decelerated.

* * * * *